US005680967A

United States Patent [19]

Dang et al.

[11] Patent Number: 5,680,967

[45] Date of Patent: Oct. 28, 1997

[54] DISPENSING CARTRIDGE

[75] Inventors: Nguyen Thai Dang, Glendale; David Paul Morris, Valencia, both of Calif.

[73] Assignee: Courtaulds Aerospace, Inc., Burbank, Calif.

[21] Appl. No.: 712,397

[22] Filed: Sep. 13, 1996

[51] Int. Cl.[6] ..... B65D 83/76

[52] U.S. Cl. ..... 222/327; 222/386

[58] Field of Search ..... 222/326, 327, 222/386, 389

[56] References Cited

U.S. PATENT DOCUMENTS

| | | | |
|---|---|---|---|
| 3,066,836 | 12/1962 | Trumbull | 222/327 |
| 3,144,966 | 8/1964 | Cook | 222/327 |
| 3,211,347 | 10/1965 | Phillips, Jr. | 222/327 |
| 4,273,270 | 6/1981 | Kray | 222/327 |
| 4,834,268 | 5/1989 | Keller | 222/327 |
| 5,301,839 | 4/1994 | Eierle et al. | 222/327 X |
| 5,316,186 | 5/1994 | Prestele | 222/327 |

FOREIGN PATENT DOCUMENTS

| | | | |
|---|---|---|---|
| 351441 | 1/1990 | European Pat. Off. | 222/327 |
| 4403434 | 10/1994 | Germany | 222/327 |

OTHER PUBLICATIONS

EFD Price List, pp. 24 and 6.

Iwashita Price List, pp. 8 and 9.

*Primary Examiner*—Kevin P. Shaver

*Attorney, Agent, or Firm*—Gifford, Krass, Groh, Sprinkle, Patmore, Anderson & Citkowski, P.C.

[57] ABSTRACT

A dispensing cartridge is provided for viscous liquids, such as sealants. The cartridge includes an elongated tubular cylindrical housing defining an elongated interior chamber having a cylindrical interior wall. A dispensing nozzle is formed at one end of the housing and this dispensing nozzle has an opening open to the housing chamber which is less in cross-sectional size than the cross-sectional size of the housing chamber. A substantially semi-spherical wall portion extends between the cylindrical wall of the housing and the nozzle opening while at least one reinforcing rib extends outwardly from an outer surface of the semi-spherical wall portion. This reinforcing rib not only reinforces the semi-spherical wall portion of the housing but also enables the cartridge to be used in a standard caulking gun.

12 Claims, 2 Drawing Sheets

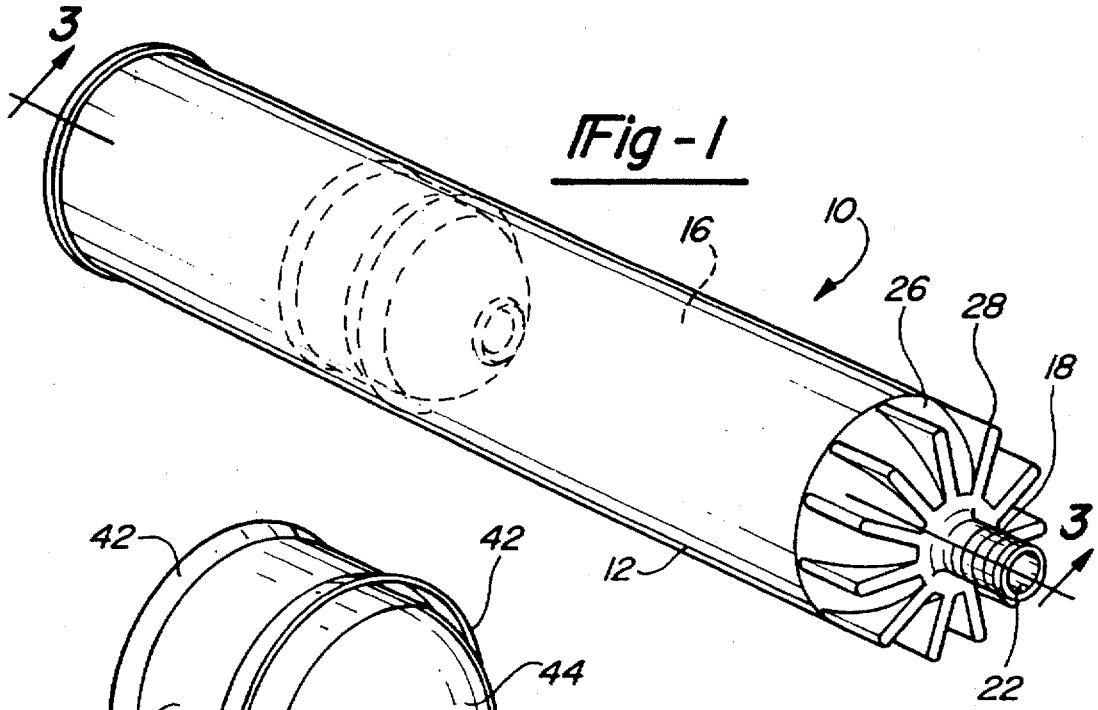
Fig-1
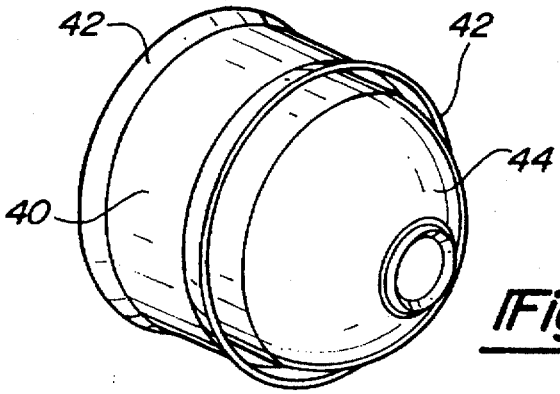
Fig-2
Fig-3
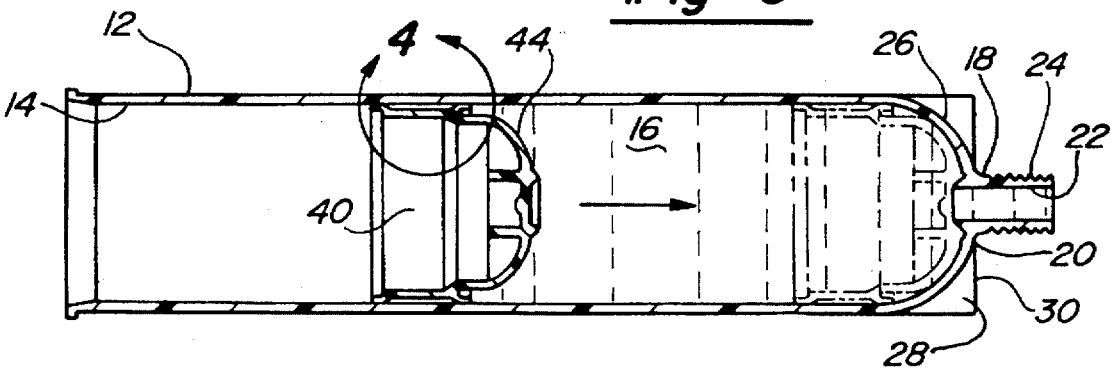
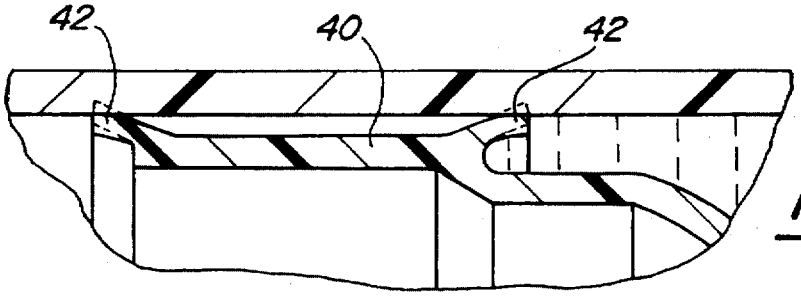
Fig-4

DISPENSING CARTRIDGE

BACKGROUND OF THE INVENTION

I. Field of the Invention

The present invention relates generally to cartridges and, more particularly, to a dispensing cartridge for viscous liquids of the type utilized in caulking guns.

II. Description of the Prior Art

There are several different types of cartridges that are conventionally used in caulking guns. In one type of cartridge, a cardboard cylindrical tube forms an elongated cylindrical chamber. One end of the chamber is enclosed by a flat end cap having a dispensing nozzle extending outwardly therefrom. The material is contained within the interior of the cartridge while a plunger is also positioned within the housing chamber at a position spaced on the dispensing nozzle. Consequently, with the cartridge positioned in a caulking gun, displacement of the plunger forces the viscous material contained within the cartridge out through the dispensing nozzle.

In still a different type of cartridge, the cartridge housing, end cap and dispensing nozzle are of a one piece plastic construction. In all other respects, however, the plastic cartridge is the same as the cardboard cartridge.

Conventionally, dispensing cartridges are manufactured in two standard sizes. One standard size fits a regular size caulking gun while, similarly, the larger size fits a large size caulking gun.

One disadvantage of these previously known cartridges, however, is that the sharp corners formed between the flat end cap and the housing are subjected to a great deal of stress during a dispensing operation. Such stress can result in cracking of the cartridge and/or other cartridge failure in use. Previously, however, it has not been possible to eliminate the sharp corners between the end cap of the cartridge and the main housing of the cartridge and still allow the cartridge to be used in a standard caulking gun.

SUMMARY OF THE PRESENT INVENTION

The present invention provides a cartridge for viscous liquids which overcomes all of the above-mentioned disadvantages of the previously known devices.

In brief, the dispensing cartridge of the present invention comprises an elongated tubular housing defining an elongated interior chamber having a cylindrical interior wall. A dispensing nozzle is formed at one end of the housing and this dispensing nozzle has an opening open to the interior chamber of the housing which is smaller in cross-sectional size than the cross-sectional size of the housing chamber.

A substantially semi-spherical wall portion extends between the housing and the dispensing nozzle so that the housing adjacent the dispensing nozzle is in the form of a dome. This dome effectively eliminates sharp corners at the dispensing end of the housing and thus minimizes any possibility of cartridge cracking during use.

In order to enable the dispensing cartridge to be utilized in a standard caulking gun, at least one, and possibly several, radially extending ribs extend outwardly from an outer surface of the semi-spherical wall portion adjacent the nozzle. These reinforcing ribs not only reinforce the structure of the cartridge housing at the nozzle end of the housing, but also form a generally planar surface which intersects the longitudinal axis of the cartridge substantially perpendicularly. As such, the reinforcing ribs enable the cartridge to be utilized in a standard caulking gun in the conventional fashion.

A cylindrical plunger is positioned within the interior of the housing so that displacement of the plunger simultaneously displaces material contained within the housing chamber. This plunger, furthermore, includes a semi-spherical dome at its end which faces the nozzle and which is complementary to the semi-spherical wall portion of the cartridge. An optional dasher is also provided in the housing chamber between the plunger and the nozzle when mixing of the plunger liquid is desired prior to dispensing.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 1 is an elevational view illustrating a preferred embodiment of the present invention;

FIG. 2 is an elevational view illustrating a preferred plunger of the present invention;

FIG. 3 is a longitudinal sectional view taken substantially along line 3—3 in FIG. 1;

FIG. 4 is a fragmentary sectional view taken substantially along circle 4—4 in FIG. 3 and enlarged for clarity;

DETAILED DESCRIPTION OF A PREFERRED EMBODIMENT OF THE PRESENT INVENTION

Figure 5:
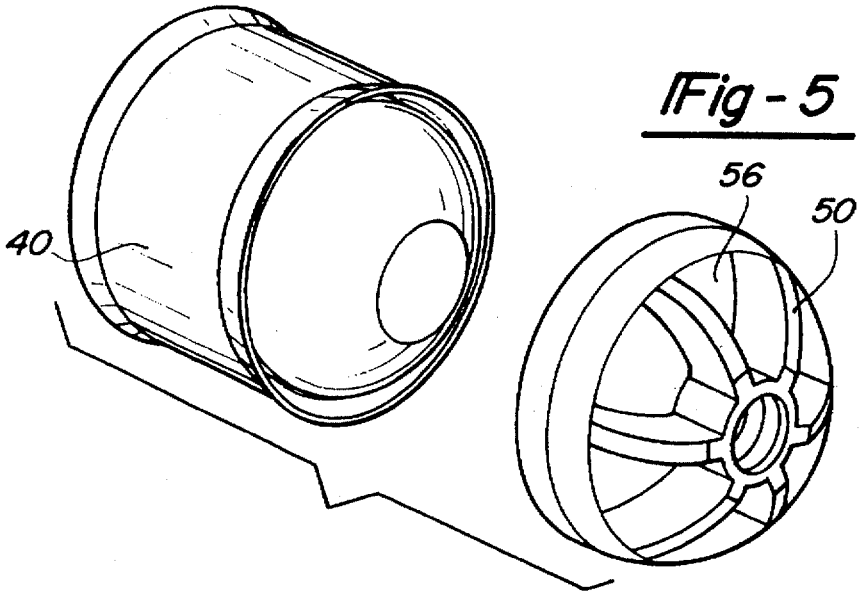
FIG. 5 is an exploded view similar to FIG. 2 illustrating a plunger with a dasher.

With reference first to FIGS. 1 and 3, a preferred embodiment of the cartridge 10 of the present invention is there shown and comprises an elongated tubular and cylindrical housing 12 having an interior cylindrical wall 14 (FIG. 3). The housing 12 thus defines a cylindrical interior housing chamber 16 in which a viscous fluid, such as a sealant, is contained.

A dispensing nozzle 18 is provided at one end 20 of the housing. This nozzle 18 includes a dispensing passageway 22 and may be externally threaded as shown at 24. Furthermore, the cross-sectional area of the dispensing passageway 22 is less than the cross-sectional area of the housing interior chamber 16 as best shown in FIG. 3.

As best shown in FIG. 3, a semi-spherical wall portion 26 extends between the housing 12 and the nozzle 18 thus forming a spherical dome at the dispensing end of the cartridge 10. Thus, the semi-spherical wall portion 26 minimizes the stress caused by the previously known flat end caps on dispensing cartridges.

Referring now especially to FIGS. 1 and 3, a plurality of radially extending reinforcing ribs 28 extend outwardly from an outer surface of the spherical wall portion 26. These reinforcing ribs 28 provide two functions. First, the reinforcing ribs 28 reinforce and rigidify the spherical wall portion 26 and protect the spherical wall portion 26 against fracture or other failure in use.

Secondly, the reinforcing ribs 28 form a generally planar surface (FIG. 3) which lies in a plane substantially perpendicular to the longitudinal axis of the housing 12. The outer radial periphery of the reinforcing ribs 28 are also substantially aligned with the outer cylindrical surface of the housing 12.

Figure 7:
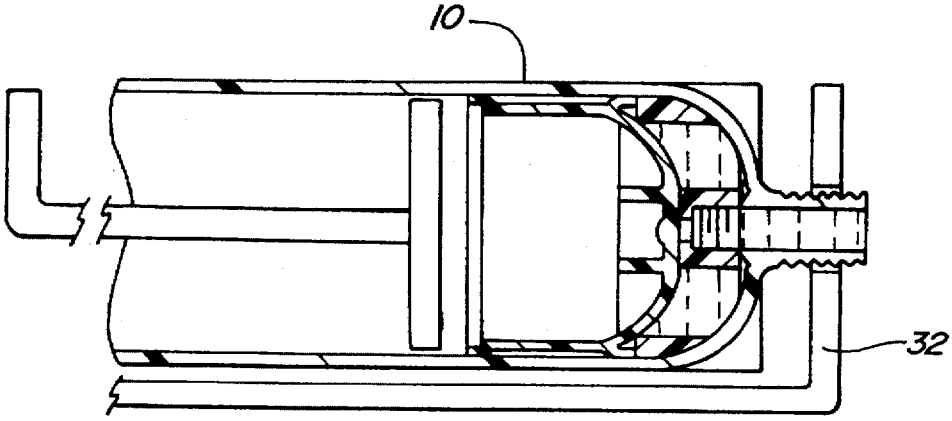
FIG. 7 is an elevational view illustrating the cartridge mounted in a caulking gun.

As best shown in FIG. 7, the reinforcing ribs 28 thus enable the cartridge 10 to be utilized with a standard caulking gun 32. Thus, when positioned in a standard caulking gun, the reinforcing ribs 28 simulate a flat end of a previously known conventional dispensing cartridge.

With reference again to FIGS. 2 and 3, a cylindrical plunger 40 having an annular seal 42 (see FIG. 4) at each end is longitudinally slidably disposed within the interior housing chamber 16. An end 44 of the plunger 40 facing the nozzle 18 is semi-spherical in shape and thus complementary to the internal shape of the semi-spherical wall portion 26. In a conventional fashion, axial displacement of the plunger 40 through the cartridge housing 12 forces material contained within the housing chamber 16 out through the nozzle opening 22. Since the end 44 of the plunger 40 is complementary to the semi-spherical wall portion 26, the plunger 40 ensures that virtually all of the material contained within the housing chamber 16 is dispensed out through the nozzle 18 when the plunger 40 is forced to the position shown in phantom line in FIG. 3.

In the preferred embodiment of the invention, the housing 12, semi-spherical wall portion 26, nozzle 18 and reinforcing ribs 28 are all of a one piece plastic construction. Similarly, the plunger 40 is also preferably of a one piece plastic construction.

Figure 6:
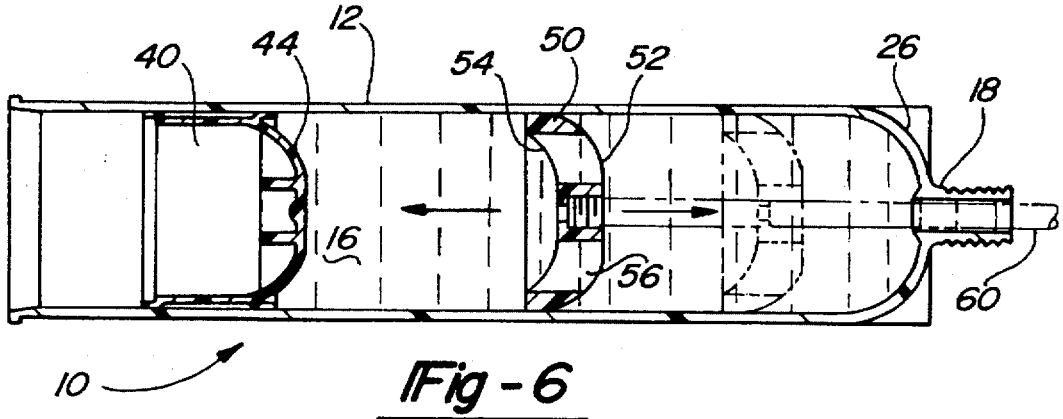
FIG. 6 is a longitudinal sectional view similar to FIG. 3, but illustrating a cartridge having a dasher.

With reference now to FIGS. 5 and 6, an alternative embodiment of the present invention is there shown in which a mixing dasher 50 is disposed within the housing chamber 16 in between the plunger 40 and the nozzle 18. The dasher 50 includes both a semi-spherical surface 52 facing the nozzle 18 as well as a semi-spherical surface 54 on its end which faces the plunger 40. The semi-spherical surface 52 is complementary to the wall portion 26 of the cartridge 10 while, similarly, the semi-spherical surface 54 is complementary to the end 44 of the plunger 40. In the well known fashion, the dasher 50 includes a plurality of openings 56 which enable the dasher 50 to be displaced through the housing chamber 16 thus intermixing the fluid contained within the housing chamber 16. A rod 60 extending through the nozzle 18 is utilized to axially move the dasher 52.

From the foregoing, it can be seen that the present invention provides an improved cartridge of the type utilized with caulking guns which eliminates the previously known stress related problems from the previously known flat ended caulking cartridges. Furthermore, the cartridge of the present invention, due to the reinforcing ribs 28, is still able to be used in a standard caulking gun.

Having described my invention, however, many modifications thereto will become apparent to those skilled in the art to which it pertains without deviation from the spirit of the invention as defined by the scope of the appended claims.

We claim:

1. A dispensing cartridge for a viscous liquid fluid comprising:

an elongated tubular housing defining an elongated interior chamber having a cylindrical interior cylindrical wall with a first cross-sectional size and an outer cylindrical wall, a dispensing nozzle at one end of said housing, said nozzle having an opening open to said interior chamber, said nozzle opening having a cross-sectional size less than said cross-sectional size of said housing chamber, said housing having a substantially semi-spherical wall portion extending between said interior cylindrical wall and said nozzle opening, and a plurality of radially extending and circumferentially spaced reinforcing ribs extending from an outer surface of said semi-spherical wall portion, each rib having an inner end integrally joined with said nozzle and an outer, axially elongated end aligned with said outer cylindrical wall.

2. The invention as defined in claim 1 wherein said housing is made of plastic.

3. The invention as defined in claim 1 wherein said housing, said nozzle and said semi-spherical wall portion are of a one piece construction.

4. The invention as defined in claim 3 wherein said rib and said housing are of a one piece construction.

5. The invention as defined in claim 1 wherein said at least one rib has an axial end surface which lies in a plane perpendicular to a longitudinal axis of said housing.

6. The invention as defined in claim 1 wherein each said rib extends in a direction substantially perpendicular to a longitudinal axis of said housing.

7. The invention as defined in claim 1 and comprising a plunger longitudinally slidably mounted in said interior chamber, said plunger having a shape at one end complementary to said semi-spherical wall portion.

8. The invention as defined in claim 7 wherein said plunger has an annular seal at each end, each annular seal sealingly engaging said interior cylindrical wall of said housing.

9. The invention as defined in claim 7 wherein said plunger is made of plastic.

10. The invention as defined in claim 9 wherein said plunger is of a one piece construction.

11. The invention as defined in claim 7 and comprising a dasher slidably positioned in said housing interior chamber between said plunger and said semi-spherical wall portion.

12. The invention as defined in claim 11 wherein an end of said dasher facing said semi-spherical wall portion is complementary in shape to said semi-spherical wall portion.

* * * * *